US006474355B1

(12) United States Patent
Jirawat et al.

(10) Patent No.: US 6,474,355 B1
(45) Date of Patent: Nov. 5, 2002

(54) PARTICLE REMOVING VACUUM SYSTEM FOR ASSEMBLY OF FBGA PACKAGES

(75) Inventors: Kasin Jirawat, Bangkok (TH); Watana Sabyeying, Nonthaburi (TH); Chuawalit Klanruengsang, Bangkok (TH); Khanchit Suphanpesat, Nonthaburi (TH)

(73) Assignee: Advanced Micro Devices, Inc., Sunnyvale, CA (US)

( * ) Notice: Subject to any disclaimer, the term of this patent is extended or adjusted under 35 U.S.C. 154(b) by 232 days.

(21) Appl. No.: 09/689,517

(22) Filed: Oct. 12, 2000

(51) Int. Cl.[7] ..... B08B 5/04

(52) U.S. Cl. ..... 137/21; 15/1.51; 15/345; 15/309.2

(58) Field of Search ..... 15/1.51, 306.1, 15/308, 309.1, 309.2, 345, 346

(56) References Cited

U.S. PATENT DOCUMENTS 1,281,925 A * 10/1918 Farnsworth
2,012,640 A * 8/1935 Shipman
3,395,042 A * 7/1968 Herbert
3,461,478 A * 8/1969 Taylor
4,751,759 A * 6/1988 Zoell
5,125,124 A * 6/1992 Saeki et al.
5,388,304 A * 2/1995 Takada
5,490,300 A * 2/1996 Horn
5,767,575 A 6/1998 Lan et al. ..... 257/701
5,923,954 A 7/1999 Cho ..... 438/108
6,011,694 A 1/2000 Hirakawa ..... 361/774
6,026,561 A 2/2000 Lafond ..... 29/722
6,205,676 B1 * 3/2001 Fujii et al.
6,249,932 B1 * 6/2001 Chu et al.

* cited by examiner

*Primary Examiner*—Terrence R. Till
(74) *Attorney, Agent, or Firm*—Amin & Turocy, LLP

(57) ABSTRACT

The present invention provides a method and system for blowing dust and other foreign particles off semiconductor substrate surfaces. The system may blow ionized air, which neutralizes electrostatic charges on the substrate surface thereby facilitating the release of particles from the substrate and reducing the risk of damage to semiconductor substrates from electrostatic discharge. The system also provides a vacuum for capturing dust particles blown off the surface, thus preventing the particles from contaminating clean room environments and redepositing on the cleaned substrate or other substrates.

15 Claims, 3 Drawing Sheets

PARTICLE REMOVING VACUUM SYSTEM FOR ASSEMBLY OF FBGA PACKAGES

TECHNICAL FIELD

The present invention generally relates to semiconductor processing, and in particular to an apparatus and method for removing small dust particles from substrates prior to assembly of Fine-pitch Ball Grid Array (FBGA) packages.

BACKGROUND OF THE INVENTION

In the semiconductor industry, there is a continuing trend toward higher device densities. To achieve these high densities there has been, and continues to be, efforts toward scaling down device dimensions (e.g., to submicron levels) on semiconductor wafers. In order to accomplish such high device packing density, smaller and smaller features sizes are required. These may include the width and spacing of interconnecting lines, spacing and diameter of contact holes, and surface geometry such as corners and edges of various features.

Assembly of devices with small feature size has necessitated the introduction of new assembly methodologies. One such methodology, which is now widely used, is Ball Grid Array (BGA) packaging. BGA packages are formed by placing an array of pads on a semiconductor substrate and solder balls on each pad.

A problem that arises, particularly when the BGA has a fine pitch, involves small dust particles interfering with the attachment of solder balls to pads. This problem is illustrated in FIG. 1, where a small dust particle 100 prevents solder ball 110 from properly contacting pad 120. As a consequence, ball 110 may be missing from the final array or insecurely attached to pad 120, resulting in defects.

High suction vacuums have been used to clean substrates. However, such vacuums are one or more of bulky, noisy, prone to mechanical breakdown, and expensive to maintain. Furthermore, high suction vacuums are not entirely effective in removing dust particles and create problems keeping the substrates in place.

One reason contaminants appear on substrates is that they are attracted by electrostatic charges that develop on the substrates during processing. High suction vacuum systems do not effectively mitigate development of these charges. Aside from attracting contaminants to the substrate surface, electrostatic charges create a risk electrostatic discharge, which can damage the semiconductor package.

There has been an unsatisfied need for better apparatus and methods that can be employed in FBGA packaging to effectively remove dust particles from substrates.

SUMMARY OF THE INVENTION

The present invention provides a method and system for blowing dust and other foreign particles off semiconductor substrate surfaces. The system may blow ionized air, which neutralizes electrostatic charges on the substrate surface thereby facilitating the release of particles from the substrate and reducing the risk of damage to semiconductor substrates from electrostatic discharge. The system also provides a vacuum for capturing dust particles blown off the surface, thus preventing the particles from contaminating clean room environments and redepositing on the cleaned substrate or other substrates.

One aspect of the present invention provides a cleaning system including a body, a blower outlet mechanically attached to the body, and a vacuum inlet mechanically attached to the body, wherein the shape of the body and the positioning of the blower outlet and vacuum inlet permit the blower outlet and vacuum inlet to be simultaneously placed in proximity to a surface to be cleaned whereby air blown from the blower outlet blows dust particles off the surface to be cleaned and blown particles are taken up through the vacuum inlet.

Another aspect of the invention provides a cleaning system including means for blowing ionized air onto a surface and means for capturing dust particles blown off the surface.

A further aspect of the invention provides a method of packaging semiconductor units including the steps of placing the units on a conveyor, conveying the units past a device that blows dust particles off the units with ionized air and captures blown dust particles with a vacuum, and subsequently conveying the units to an area where solder balls are attached to the units.

DETAILED DESCRIPTION OF THE INVENTION

Figure 1:
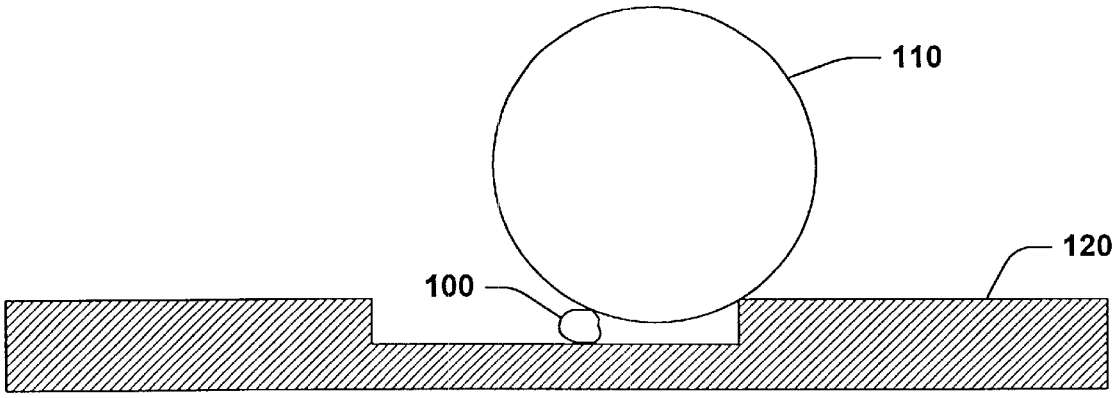
FIG. 1 is an illustration of a dust particle blocking a solder ball from properly contacting a pad.

One aspect of the present invention involves cleaning substrates by blowing air across their surfaces and capturing blown particles using a vacuum. The blown air emanates from a blower and is preferably ionized. Ionized air helps prevent static discharge, which could damage semiconductor parts, and also facilitates release of particles from the substrate surface. The vacuum system is positioned to capture dust particles blown off the surfaces. Blown particles are immediately captured, thereby preventing them from migrating into the environment around the cleaning device and re-contaminating the substrate being cleaned, or other substrates. The invention is useful in integrated circuit packaging systems, such as a Fine-pitch Ball Grid Array packaging system.

The cleaning system removes particles having any size that can be captured by the system. In one embodiment, the cleaning system is particularly suited for removing particles having sizes from about 10 to about 500 $\mu$m. In another embodiment, the system is particularly suited for removing particles having sizes from about 50 to about 300 $\mu$m.

The present invention will now be described with reference to the drawings, wherein like reference numerals refer to like elements throughout.

Figure 2:
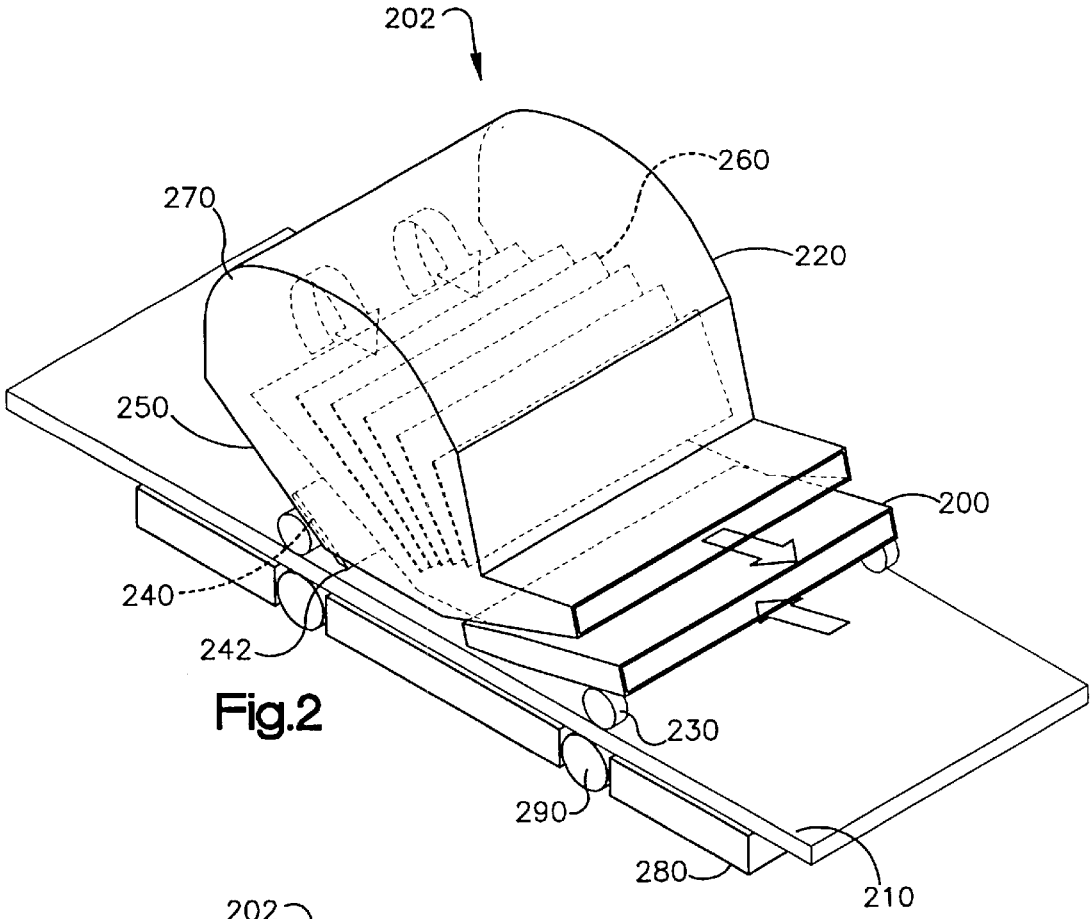
FIG. 2 is an illustration of a device according to the present invention, viewed from an oblique angle.
Figure 3:
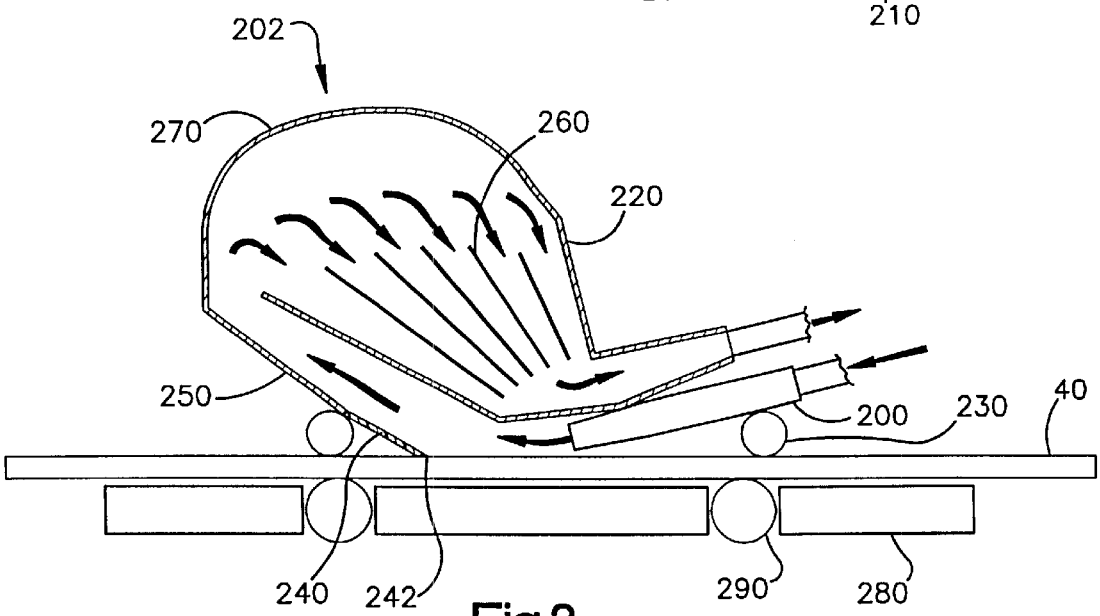
FIG. 3 is an illustration of a device according to the present invention, viewing the device in cross-section from one side.

FIGS. 2 an 3 are illustrations showing main parts of a device and system 202 for removing particles in accordance with the invention. Apparatus 202 includes body 220, blower nozzle 200, vacuum inlet 250, air curtain 240, intake manifold 270 formed by body 220, a vacuum system, which is not shown, vanes 260 within intake manifold 270, and wheels 230. Substrate 210 is not part of the device, but is illustrated to put the device in context. Likewise, the illustrations include transportation rail 280 with rollers 290 that carry substrate 210 past device 202.

Nozzle 200 is connected to an air blower that pressurizes air and expels it through nozzle 200, which is the blower outlet. In one embodiment, the air blower compresses air to a pressure from about 20 to about 120 psi. In another embodiment, the blower compresses air to a pressure from about 25 to about 50 psi. The blown air is preferably ionized air. The air may be ionized, before, during, or after compression. A commercially available ionized air blower may be used, a SemiTone Model AC7200 Air Knife for example. Ionized air is formed by splitting some of the air molecules into positively and negatively charged ions. Oppositely charged ions are attracted to and neutralize charges on substrate surfaces.

Nozzle 200 is preferably broad and flat, having a width that is slightly less than or greater than or equal to the width of the substrates the device is to clean. Nozzle 200 is mounted on body 220 so that nozzle 200 directs air at an angle against the substrate to be cleaned 210. Preferably, the nozzle directs air against the substrate at an angle that is from about 5 to about 45 degrees from a plane parallel to the substrate surface.

Wheels 230, which are attached to body 220, are positioned to roll across the surface to be cleaned 210. Wheels 230 maintain a gap between nozzle 200 and substrate 210. In one embodiment, this gap is from about 0.1 mm to about 2.5 cm. In another embodiment, the gap is from about 0.1 mm to about 1 cm. In yet another embodiment, the gap is from about 0.1 mm to about 2 mm. Optionally, one pair of wheels 230 is attached to body 220 through nozzle 200.

Air curtain 240 forms part of the inlet to the vacuum system. Only a portion of the vacuum system is shown. For device 202, the forward edge 242 of the air curtain 240 marks the beginning of the vacuum inlet. The vacuum inlet is relatively close to the blower outlet, which is at the end of nozzle 200. In one embodiment, the vacuum inlet is from about 0.01 to about 10 cm from the blower outlet. In another embodiment, the vacuum inlet is from about 0.1 to about 5 cm from the blower outlet. In a further embodiment, the vacuum inlet is from about 0.5 to about 2 cm. On device 202, this distance is 0.5 cm or greater, measured from nozzle 200 to the forward edge 242 of air curtain 240.

Air curtain 242 is designed to slide across the surface of the substrate to be cleaned 210 and direct particles blown off the surface into vacuum manifold 270. A major portion (at least about 50%) of the air expelled by the blower is taken up through the vacuum intake. In one embodiment, at least about 90% of the air is taken up. In another embodiment, at least about 95% of the air is taken up. Likewise, a majority of the particles (at least about 50% by weight) blown off the surface of the substrate is taken up by the vacuum system. In one embodiment, at least about 90% of the blown dust and other foreign particles is captured by the vacuum system. In a further embodiment, at least about 95% of the blown dust and other foreign particles is captured by the vacuum system.

The vacuum inlet opens into inlet manifold 270. Manifold 270 is an integral part of body 220. Inlet manifold 270 has a shape that facilitates keeping particles within the vacuum system once they are blown through the vacuum inlet. Inlet manifold 270 narrows along its length. Preferably, from its broadest point, the manifold cross section narrows and reduces by a factor from about 2 to about 20.

Manifold 270 contains a plurality of vanes 250, which are attached to manifold 270. Vanes 250 channel air flowing within the manifold toward the narrow end of the manifold, which is the manifold exit. As air flows through the narrowing channels formed by vanes 250, the air accelerates, further contributing to the ability of the system 202 to trap particles within the vacuum system.

The volume of air flow into the vacuum system is usually equal to or greater than the flow rate from the blower. In one embodiment, the volumetric flow rate into the vacuum system is from about 10 to about 1000 cfm (cubic feet per minute). In another embodiment, the volumetric flow rate is from about 30 to about 400 cfm. In a further embodiment, the volumetric flow rate is from about 75 to about 200 cfm.

The vacuum system, of which only the inlet side is shown, is generally designed to convect air and particles out of a clean room environment. Therefore the vacuum system of the apparatus according to the invention may be no more than a coupling adapted to attach to the main exhaust of a clean room. The vacuum system may include a vacuum pump or a connection to a vacuum pump or similar apparatus.

Figure 4:
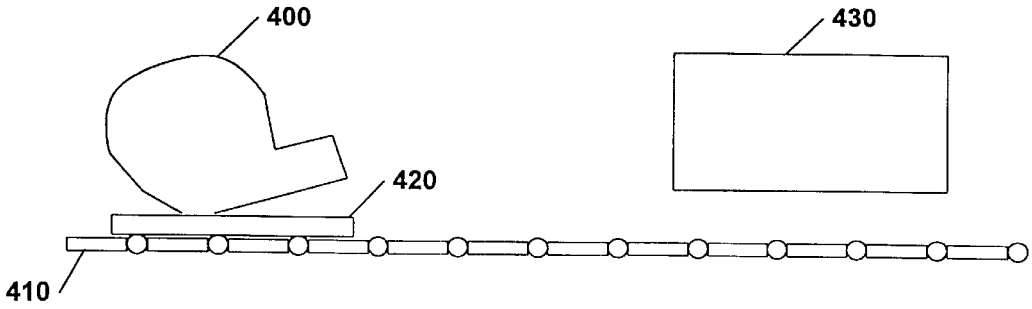
FIG. 4 is a schematic of a BGA process according to on aspect of the present invention.
Figure 5:
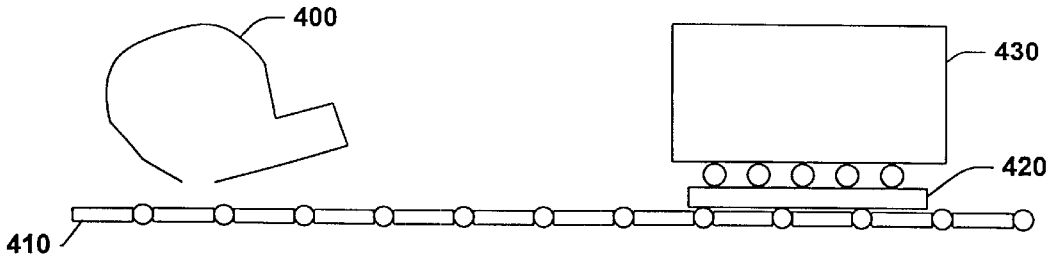
FIG. 5 is a schematic of the BGA process of FIG. 4, where the substrate has advanced to the ball attach area.

FIGS. 4 and 5 are schematics of a Ball Attach system using a cleaning device according to the invention. Cleaning device 400 is positioned above transportation rail 410. In FIG. 4, substrate 420 is cleaned by device 400. FIG. 5 shows substrate 420 carried by transportation rail 410 to Ball Attach site 430. In one embodiment, cleaning device 400 is physically attached to transportation rail 410 from an area below cleaning device 400. In another embodiment, cleaning device 400 is not attached to transportation rail 410, but is positioned above it. Orientation and level control systems on the transportation rail in the vicinity of the cleaning device may be used to help avoid scratching the substrates.

Although the invention has been described as being used in a Ball Attach system, it has other applications. Devices of the invention may be used advantageously in other bonding processes where contaminants and/or electrostatic charges are a concern, e.g., die attaching and wire bonding.

What has been described above is the present invention and several of its specific embodiments. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A cleaning system for cleaning semiconductor substrates, comprising:

a body;

a blower outlet mechanically attached to the body; and a vacuum inlet mechanically attached to the body;

wherein the shape of the body and the positioning of the blower outlet and vacuum inlet permit the blower outlet and vacuum inlet to be simultaneously placed in proximity to a semiconductor substrate surface to be cleaned whereby air blown from the blower outlet blows dust particles off the semiconductor substrate surface to be cleaned and blown particles are taken up through the vacuum inlet, and the vacuum inlet expands into an inlet manifold and the inlet manifold narrows along its length, whereby particles taken in through the vacuum inlet accelerate as they travel through the manifold, the inlet manifold is integral with the body and the inlet manifold comprises an exit and a series of vanes that channel air flowing in the manifold toward the exit.

2. The cleaning system of claim 1, wherein ionized air is expelled through the blower outlet.

3. The cleaning system of claim 1, further comprising rollers attached to the body and positioned to roll across the semiconductor substrate surface to be cleaned.

4. The cleaning system of claim 3, wherein when the rollers are against a flat semiconductor substrate surface to be cleaned, the blower outlet is within about 2.5 cm of the semiconductor substrate.

5. The cleaning system of claim 1, further comprising an air curtain attached to the body and positioned to runs across the semiconductor substrate surface to be cleaned and direct air from the blower into the vacuum.

6. The cleaning system of claim 1, wherein at least about 90% by weight of the dust particles blown off the semiconductor substrate surface are taken up through the vacuum inlet.

7. The cleaning system of claim 1, wherein the blower outlet is less than about 5 cm from the vacuum inlet.

8. The cleaning system of claim 1, wherein the majority of the air blown out the blower outlet is taken in through the vacuum inlet when the system is positioned in proximity to a semiconductor substrate surface to be cleaned of dust particles.

9. The cleaning system of claim 8, wherein at least about 90% by weight of the air blown out the blower outlet is taken in through the vacuum inlet.

10. The cleaning system of claim 1, wherein the vacuum inlet is attached to and in fluid communication with a coupling that is adapted to connect with a clean room vacuum system.

11. The cleaning system of claim 1, wherein the blower outlet is a nozzle connected to an air blower.

12. The cleaning system of claim 11, wherein the air blower pressurizes air to at least about 20 psi.

13. A cleaning system for cleaning semiconductor substrates, comprising:

means for blowing ionized air onto a semiconductor substrate surface, the blowing means attached to a body;

means for capturing dust particles blown off the semiconductor substrate surface, the capturing means attached to the body; and wherein the shape of the body and the positioning of the blowing means and capturing means permit the blowing means and capturing means to be simultaneously placed in proximity to a semiconductor substrate surface to be cleaned whereby air blown from the blowing means blows dust particles off the semiconductor substrate surface to be cleaned and blown particles are taken up through the capturing means, and the capturing means expands into an inlet manifold and the inlet manifold narrows along its length, whereby particles taken in through the capturing means accelerate as they travel through the manifold, the inlet manifold is integral with the body and the inlet manifold comprises an exit and a series of vanes that channel air flowing in the manifold toward the exit.

14. A method of cleaning a semiconductor substrate surface, comprising:

providing a cleaning system comprising a body; a blower outlet mechanically attached to the body; and a vacuum inlet mechanically attached to the body; wherein the shape of the body and the positioning of the blower outlet and vacuum inlet permit the blower outlet and vacuum inlet to be simultaneously placed in proximity to a semiconductor substrate surface to be cleaned whereby air blown from the blower outlet blows dust particles off the semiconductor substrate surface to be cleaned and blown particles are taken up through the vacuum inlet, and the vacuum inlet expands into an inlet manifold and the inlet manifold narrows along its length, whereby particles taken in through the vacuum inlet accelerate as they travel through the manifold, the inlet manifold is integral with the body and the inlet manifold comprises an exit and a series of vanes that channel air flowing in the manifold toward the exit;

blowing ionized air onto the semiconductor substrate surface; and using a vacuum to capture dust particles blown off of the semiconductor substrate surface.

15. The method of claim 14, wherein:

blowing ionized air comprises running the semiconductor substrate surface past a blower outlet; and capturing dust particles comprises running the semiconductor substrate surface past a vacuum inlet.

* * * * *